United States Patent [19]

Tuttle et al.

[11] 3,985,585

[45] *Oct. 12, 1976

[54] PROCESS FOR TREATING ALUMINUM WITH FERRICYANIDE COMPOUND

[75] Inventors: Bertha S. Tuttle, Harwichport; Jekabs Ozolins, Holliston, both of Mass.

[73] Assignee: J. N. Tuttle, Inc., Medford, Mass.

[ * ] Notice: The portion of the term of this patent subsequent to Oct. 16, 1990, has been disclaimed.

[22] Filed: July 24, 1975

[21] Appl. No.: 598,713

Related U.S. Application Data

[63] Continuation-in-part of Ser. No. 399,753, Sept. 21, 1973, Pat. No. 3,897,278, which is a continuation-in-part of Ser. No. 170,668, Aug. 10, 1971, Pat. No. 3,765,952.

[52] U.S. Cl. ..... 148/6.27; 148/6.1; 148/6.15 R

[51] Int. Cl.[2] ..... C23F 5/04

[58] Field of Search ..... 148/6.1, 6.27; 252/387

[56] References Cited

UNITED STATES PATENTS

| | | | |
|---|---|---|---|
| 3,505,129 | 4/1970 | Barstein et al. | 148/6.27 |
| 3,549,540 | 12/1970 | Dollman | 134/3 |
| 3,765,952 | 10/1973 | Tuttle et al. | 148/6.27 X |
| 3,897,278 | 7/1975 | Tuttle et al. | 148/6.27 X |

*Primary Examiner*—Ralph S. Kendall
*Assistant Examiner*—Charles R. Wolfe, Jr.
*Attorney, Agent, or Firm*—Robert L. Goldberg

[57] ABSTRACT

The invention is for an improved process for chemically forming a protective, color receptive coating on the surface of aluminum. The aluminum may be aluminum parts or substrates coated with a layer of aluminum. Absent conventional steps such as water rinses and the like, the process comprises cleaning the aluminum surface to the extent necessary, including desmutting, and contacting the part with a spray comprising an aqueous alkaline solution of a ferricyanide compound, with or without added oxygen, for a time sufficient to form the coating. The treatment is believed to be a chemical oxidizing step similar to the formation of an oxide film electrically using a conventional anodizing process.

20 Claims, No Drawings

PROCESS FOR TREATING ALUMINUM WITH FERRICYANIDE COMPOUND

CROSS-REFERENCE TO RELATED APPLICATIONS

This application is a continuation-in-part of U.S. Pat. application Ser. No. 399,753, filed Sept. 21, 1973, now U.S. Pat. No. 3,897,278, which is in turn a continuation-in-part of U.S. Pat. application Ser. No. 170,668, filed Aug. 10, 1971, now U.S. Pat. No. 3,765,952.

BACKGROUND OF THE INVENTION

1. Introduction

This invention relates to the chemical formation of protective, color receptive coatings on aluminum metals.

2. Description of the Prior Art

Methods for providing integral coatings on aluminum that are corrosion resistant, may be dyed, and act as bases for various finishes such as paint are known in the art. The most common method is anodizing which is an electrochemical method. Using anodizing procedures, a coating is formed on an aluminum part by passage of a current through an electrolyte such as sulphuric acid wherein the aluminum part is the anode and the tank is the cathode. Subsequent to formation of the coating, the part may be immersed in a dye bath to impart color to the coating. A process for anodizing aluminum is disclosed in the Metal Finishing Guidebook Directory for 1967, Metals and Plastics Publications, Inc., Westwood, New Jersey, pages 515 to 525.

Though anodizing is one of the most widely used methods for the oxidative treatment of aluminum, several disadvantages limit its efficiency. These include the high cost of anodization due to special equipment associated with electrolytic cells and power costs. Thus, electrodes, rectifiers, and specially lead lined or stainless steel tanks are required. Further, after prolonged use, the electrolyte must be discarded due to aluminum buildup.

To overcome some of these limitations, chemical methods for forming protective and color receptive aluminum surfaces have been suggested. The most widely used of these is disclosed in U.S. Pat. No. 2,976,371, incorporated herein by reference. In the process of said patent, there is disclosed an acidic treatment solution comprising a mixture of a chromic compound selected from the group of chromic acid and water soluble salts thereof and a ferricyanic acid and water soluble salts thereof. This treatment method effects a colorable complex of aluminum and chromic acid on immersion in said solution. This complex is capable of finishing such as by dyeing, painting or lacquering.

The above chemical means, while avoiding several of the disadvantages inherent in anodization, yields a soft coating that is dull in appearance, non-uniform, not heat resistant and which yields iridescent colors upon dyeing. Further, the chromic acid solutions present disposal problems.

In co-pending U.S. patent application Ser. No. 399,753, filed on Sept. 21, 1973, and in our U.S. Pat. No. 3,765,952, both incorporated herein by reference, a process for treating aluminum to provide a corrosion and heat resistant coating that is readily dyed is disclosed. In accordance with said process, an aluminum part is cleaned and desmutted as necessary and immersed in an aqueous alkaline solution of a ferricyanide compound for a time sufficient to treat the surface of the part. The treatment of the part with aqueous alkaline ferricyanide solution is believed to chemically form an oxide coating on the surface of the aluminum part similar to that formed electrolytically in an anodizing process. Subsequent to such treatment, the part may be dyed and/or finished as desired with for example suitable dyes, paints, and lacquers.

The aforesaid process overcomes the disadvantages noted above with respect both to anodizing and chemical treatment such as that disclosed in U.S. Pat. No. 2,976,371. Thus, the expensive electrical equipment and systems of the anodizing process are not needed. Yet, a coating is produced that is harder, more corrosion and heat resistant and receptive to more uniform, brighter and substantially more decorative finishes than that of prior chemical processes.

SUMMARY OF THE INVENTION

The process and parts produced by said process as disclosed herein are improvements over the process and parts of both U.S. Pat. No. 3,765,952 and co-pending U.S. patent application Ser. No. 399,753, now U.S. Pat. No. 3,897,278. With respect to the process, treatment time and consumption of treatment solution are substantially reduced and the solution is capable of use for longer periods of time. With respect to parts treated by the process, coatings are formed in reduced time or, with extended time, the coatings are thicker and have significantly increased hardness thus increasing their wear resistance. Moreover, because spray equipment is involved, substantially larger parts may be treated than is practical employing immersion procedures.

The process of the invention is similar to that of the aforesaid U.S. Pat. No. 3,765,952 except that the aluminum part to be treated is sprayed with the ferricyanide solution rather than immersed in said solution, and the solution itself is preferably aerated or admixed with oxygen gas, particularly at the latter part of the treatment.

Though not wishing to be bound by theory, it is believed that spraying the aluminum part is an improvement because the solution is aerated as it is sprayed thus picking up oxygen from th air which serves the dual purposes of enhancing the oxidation reaction on the aluminum part during treatment and decreasing chemical consumption, perhaps by re-oxidizing ferrocyanide to ferricyanide in the treatment solution or by providing oxygen at the surface of the part thereby decreasing the quantity of ferricyanide required or a combination of the two. These two effects are believed to be further enhanced when air, or preferably oxygen, is introduced into the treatment solution during use by metering the same into the solution during the step of spraying, more preferably, during the latter stages of the spray treatment.

DESCRIPTION OF THE PREFERRED EMBODIMENTS

The invention described herein relates to the treatment of aluminum parts. Aluminum parts, as defined herein, include not only parts formed from said aluminum and its alloys, but also parts coated with aluminum and its alloys such as plastic substrates coated, such as by vacuum deposition, with aluminum. While the thickness of the coating is not critical, it should be understood that with extremely thin coatings, e.g. 2000 angstroms or less, the oxidizing solution may attack the metal to such extent that no chemical coating will be formed.

Prior to treating a part in accordance with this invention, the part is preferably cleaned to the extent necessary. Cleaning can be effected by a combination of steps comprising solvent degreasing, preferably with a hydrocarbon solvent such as benzene to remove grease and oil, etching with a mild acid or aklaline cleaner to remove dirt, oxides and other surface contaminants, and desmutting with conventional desmutters, such as admixtures of dilute nitric with or without hydrofluoric acid, to remove any surface residues. Intermediate to each of the above steps, a conventional water rinse should be used. The above process of cleaning and desmutting is well known in the art.

Following surface preparation, the process in accordance with this invention comprises what is believed to be the chemical formation of an oxide film on the surface of the aluminum part, which film is considered to be simlar in function to the oxide film formed electrochemically in conventional anodizing processes. The treatment solution to form the coating is an aqueous, alkaline solution of a ferricyanide compound. While ferricyanide salts having cations which will not deposit on the metal part may be employed in accordance with this invention, said salts are preferably alkali or alkaline earth metal ferricyanides. The concentration of said salt is not critical, from 0.01 moles per liter to saturation being a satisfactory range. However, at low concentration ranges, the process is less practical due to the extended treatment times requied. Hence, the preferred concentration of said ferricyanide salt ranges from about 0.1 to 0.5 moles per liter and most preferably, from about 0.2 to 0.3 moles per liter.

The oxidizing solution of this invention is an aqueous, alkaline solution of pH between about 7.5 to 14.0. To obtain said solution pH, a pH adjuster such as phosphoric acid, hydroxides, carbonates, or tribasic phosphates is preferably used. Examples of such pH adjustors include alkali and alkaline earth metal hydroxides, alkali carbonates and tribasic phosphates. The most preferred of these pH adjustors are the sodium and potassium salts of said hydroxides, carbonates and tribasic phosphates.

As a mixture of carbonate and tri-basic phosphate salts act as a buffer, they are preferably used in combination, particularly wherein the tri-basic phosphate also functions as a metal inhibitor as will be explained in more detail below. The amount of pH adjustor used is that amount that gives the desired pH. Using potassium carbonate as an example, from about 0.01 to 0.1 moles per liter of solution provides a pH below about 12 and from about 0.5 to about 0.75 moles per liter of solution of a combination of potassium carbonate, alkaline tri-basic phosphate and sodium hydroxide, the sodium hydroxide being used in the minimum amount necessary relative to the potassium carbonate to reach the desired pH, provides a pH of about 12.5. It should be noted that potassium carbonate alone without the sodium hydroxide and tri-basic phosphate cannot be used to obtain these high pH values.

It is also desirable to include an inhibitor for aluminum in the oxidizing solution to reduce darkening of the oxide coating and to produce brighter finish color on subsequent dye contact during the processing sequence. A suitable inhibitor is an aforesaid tri-basic phosphate such as tri-basic sodium sodium phosphate and tri-basic potassium phosphate. Thus, the tri-basic phosphate may be both an inhibitor and a pH adjustor. The amount of the tri-basic phosphate is not critical, small amounts providing some benefit with larger amounts providing greater benefit. In general, the concentration may vary from as low as 0.001 moles per liter to saturation or even in excess of saturation. A preferred range for said tri-basic phosphate is from 0.04 to 0.50 moles per liter.

A preferred formulation in accordance with the invention is as follows:

| | |
|---|---|
| Potassium ferricyanide | 0.1 to 0.5 moles per liter |
| Potassium carbonate | 0.1 to 0.5 moles per liter |
| Trisodium phosphate | sufficient to provide desired pH |
| Water | to 1 liter |

The oxidizing solution of this invention is used at a temperature commensurate with the pH of the solution and the aluminum alloy being treated. Thus, if the pH of the solution is between 7.5 and 10, the temperature is maintained between about 100° F and the boiling point of the solution. If the pH of the solution is between 13 and 14.0, the temperature of the solution is maintained within a range of about 2° F above the freezing point of the solution to about 50° to 60° F. However, temperatures as high as about 70° F can be used if treatment precautions are exercised. It should be understood that temperatures are inversely related to pH. In other words, as the pH is increased from 13 to 14.0, the temperature is correspondingly decreased and as the pH is decreased from 10 down to about 7.5, the temperature is correspondingly increased.

The time of contact of the metal part with the treatment solution is not critical, periods of time ranging from ½ to 20 minutes being suitable and from 1 to 10 minutes being typical. It should be noted that spraying in accordance with this invention, unexpectedly reduces treatment time by more than 50% to obtain comparable coatings as compared to immersion treatment. Thus, in a typical application, an immersion treatment could require 12 to 20 minutes immersion. By spraying, this time could be reduced to 4 to 8 minutes.

In general, those alloys containing a high copper content require a shorter treatment than those with a lower copper content. Further, it should be understood that there is a relationship between the concentration of ingredients in the oxidizing solution temperature and time; more concentrated solutions or higher temperature or a combination of two resulting in shorter treatment time.

The contact of the treatment solution with the part in accordance with this invention is effected by spraying said solution onto the surface of said part. Such spraying, employing conventional spray nozzles and equipment well known in the art, converts the treatment solution into a finely divided spray. Contact of the part with the spray is believed to cause rapid oxidation of the part and unexpectedly forms a coating which is substantially harder and more dyeable than that obtained using the immersion procedures of the prior art. Further, spraying is characterized by more efficient utilization of the treatment chemicals of the alkaline treatment solution as aeration is believed to oxidize the ferrocyanide formed during treatment back to ferricyanide or provide oxygen at the surface of the part being treated thus enhancing the oxidation process or a combination of the two. Thus, spraying in accordance with this invention, permits parts to be treated in a manner which is more economical both as to the treatment solution which can be more dilute and the time required for coating yet is productive of a substantially harder and more dyeable oxide coating. Moreover, spraying permits treatment of parts of a wider size range and further increases the ability to use automated equipment.

While the improved coating in accordance with this invention is formed by the contact of the part with the treatment solution by simple spraying, in a preferred embodiment of this invention, air or, more preferably, oxygen gas is added to the spray, especially near the end of the contact period. Such inclusion effects an even harder and more dyeable coating and significantly aids in the more efficient use of the treatment solution. While the timing and extent of said oxygen inclusion is not critical, preferably such inclusion is most effective during the latter portions of the spraying period, and most preferably, during the final three to five minutes. The amount of air or oxygen added to the solution during spraying is not critical, some benefit being obtained with amounts as low as 0.001 cubic feet of oxygen per gallon of solution. Amounts up to and exceeding saturation of the solution are acceptable.

Following treatment with the ferricyanide solution, the aluminum part is rinsed and may be coated with any finish such as those disclosed in U.S. Pat. No. 2,976,371 incorporated herein by reference, or a solution of a colorant, which may be either an organic dye or even an inorganic pigment. Many of the colorants that may be used are those conventionally used in anodizing. Typical of such dyes are the following, set forth for purposes of example only:

| | |
|---|---|
| Aluminum Orange 3A | |
| Anthraquinone Green GNN | C.I. 61570 |
| Alizarin Orange 2GN | C.I. 14030 |
| Aluminum Fiery Red ML | |
| Wool Fast Orange GA | C.I. 26520 |
| Fast Mordant Yellow GD | C.I. 25100 |
| Chromoxane Pure Blue BA | C.I. 43830 |
| Chlorontine Fast Red 5 BRL | C.I. 35780 |

The parts treated with the alkaline solution of the ferricyanide may be colored in accordance with prior art anodizing treatment procedures. Thus, dye concentration, treatment temperature and time are conventional, temperatures of from room to 150° F being appropriate with treatment time ranging from about ½ to 20 minutes dependent on dye concentration temperature, lower temperatures requiring longer times. It should be noted that dye concentration for coloring parts treated in accordance with this invention can be substantially reduced relative to those concentrations needed for dyeing aluminum anodized in the conventional manner.

Following dyeing and a water rinse, the part may be sealed if desired, using the conventional sealing step of immersion of the colored part in a solution such as nickel acetate or sodium dichromate or any other conventional material in accordance with art-recognized procedures.

The following examples are given for the purpose of illustrating the invention. Example 1 below is set forth to illustrate the procedure as set forth in the above noted co-pending application and the examples that follow example 1 illustrate the process of this subject invention.

EXAMPLE 1

An aluminum panel of No. 5056 alloy measuring 2 × 4 × 0.016 inches is degreased by soaking for five minutes in a conventional non-etching aluminum soak cleaner made up at 60 grams per liter and maintained at 150° F. The panel is then removed, water rinsed, and next immersed in a conventional mild alkaline etching cleaner consisting of 55 grams of cleaner (Clepco No. 30R) dissolved in one liter of water. The cleaning bath is maintained at about 150° F, the panel is removed after about 1 minute treatment in the bath and rinsed in cold water. The clean panel is then immersed in a 10% nitric acid solution to desmut the same and provide a clean surface. A treatment time of ½ minute is used. The clean panel is rinsed with cold water, treated with a brightening solution, desmutted, rinsed again and immersed in a solution comprising 80 grams of potassium ferricyanide, 40 grams of potassium carbonate, 40 grams of trisodium phosphate and water to 1 liter. The pH of the solution is maintained at about 12.0, the temperature of the solution is held at about 65° F and immersion time is about 20 minutes. Thereafter the panel is removed and rinsed with water. The panel, having an oxide coating, is then dyed by immersion for 5 minutes in a dye bath maintained at about 90° F consisting of 4 grams of Chromoxane Pure Blue BA (C.I. 43830) in one liter of water. The pH of the dye is adjusted to between 7.0 and 8.0. The dyed panel is rinsed with water and sealed in a solution containing 0.5 grams of sodium dichromate dissolved in one liter of water with the pH maintained at about 5.5. The time of sealing is 25 minutes and the temperature of the sealing bath is maintained at about 60°–90° F. The panel is then rinsed with water, dried in air, and buffed by hand. It has a uniform bright blue coloration and has good wear and corrosion resistance properties.

EXAMPLE 2

The procedure of Example 1 is repeated except that the contact of the metal part with the treatment solution is effected by spraying for a period of 8 minutes using a Spares full cone nozzle No. 6P at a flow rate of 5.5 gal/min. and a spray pressure of 20 psig. Dyeing of the panel as before resulted in a uniform bright blue coloration having improved hardness, wear and corrosion resistance properties.

EXAMPLE 3

The procedure of Example 2 is repeated except that during the final 3 minutes of the spraying, oxygen gas is added to the spray. After dyeing as before, a bright deep blue colored panel of excellent hardness, wear and corrosion resistance properties was obtained, said coating being substantially improved over the coating obtained following the procedures of Example 2.

EXAMPLE 4

The procedure of Example 3 is repeated except the concentration of the potassium ferricyanide is increased to 140 grams. The resultant panel again exhibits a deep blue colored protective coating of excellent hardness, wear and corrosion resistance properties.

The colored surface such as those formed in Examples 1–4 may be bleached with concentrated, cold nitric acid and then re-dyed, such as if the color is not correct. This supports the belief that the coating formed by the process herein is an oxide coating.

It will be noted that the present invention provides a process for treating and coloring aluminum which is low in cost; does not require electrical equipment; and can be applied to varied sized parts such as pins, bolts and the like as well as large parts as in the prior art anodizing methods. The colorant appears to be uniformly distributed throughout the coating formed by the treatment process and is adherent to the aluminum part. The resulting colored aluminum parts have a deeper shade and are more attractive and harder than are those coatings that have heretofore been obtainable on chemically treated aluminum or aluminum alloy surfaces.

We claim:

1. A process for forming a corrosion and heat resistant, readily dyeable coating on member selected from the group of aluminum, its alloys, and substrates having an aluminum or aluminum alloy surface, said process comprising the step of formation of said coating using chemical means consisting of contacting the surface of said part with a spray comprising an aqueous alkaline solution of a ferricyanide salt having a pH between about 7.5 and 14.0, said ferricyanide salt being present in an amount of at least 0.01 moles per liter of solution.

2. The process of claim 1 where the ferricyanide salt is present in an amount of from 0.1 to 0.5 moles per liter of solution.

3. The process of claim 2 where the pH of the ferricyanide solution varies between about 7.5 and 14.

4. The process of claim 3 where the pH of the ferricyanide solution varies between about 10 and 13.

5. The process of claim 2 including the step of contacting the coated aluminum part with a colorant solution.

6. The process of claim 2 where the temperature of said solution varies between about 2° F in excess of the freezing point of the solution and the boiling point of the solution.

7. The process of claim 6 where the temperature varies between about 70° F and 100° F.

8. The process of claim 2 where the ferricyanide solution contains a pH adjustor in an amount sufficient to provide the required pH which pH adjustor is selected from the group consisting of alkali carbonates, alkali or alkaline earth metal hydroxides, alkali tribasic phosphates and mixtures thereof.

9. The process of claim 2 where the ferricyanide solution contains an inhibitor for aluminum that prevents darkening of the oxide coating and enhances dyeability.

10. The process of claim 9 where the inhibitor is a tri-basic phosphate contained in solution in an amount at from 0.01 moles per liter of solution to saturation.

11. The process of claim 2 wherein said spray is admixed with a member selected from the group of air and gaseous oxygen.

12. The process of claim 11 where the spray is admixed with gaseous oxygen at some point during the final five minutes of contact of the part with said treatment solution.

13. A process for forming a corrosion and heat resistant readily dyeable coating on a member selected from the group of aluminum, its alloys, and substrates having an aluminum or aluminum alloy surface, said process comprising the steps of formation of said coating using chemical means consisting of contacting the surface of said part with a spray comprising an aqueous alkaline solution of a ferricyanide salt in an amount of from 0.1 to 5 moles per liter, a carbonate salt in an amount of from 0.1 to 5 moles per liter and a trisodium phosphate salt in an amount sufficient to provide an alkaline pH.

14. The process of claim 13 where pH is ajusted to between 10 and 13.

15. The process of claim 13 where the temperature of the solution varies between room temperature and the boiling point of the solution.

16. The process of claim 13 where the spray is admixed with a gas selected from the group of air and oxygen.

17. The process of claim 16 where the volume of the gas is at least 0.001 cubic feet per gallon of solution.

18. The process of claim 17 where the volume of gas exceeds saturation.

19. The process of claim 16 where the gas is oxygen.

20. The process of claim 16 where the gas is mixed at some point during the latter 5 minutes of contact of the part with the treatment solution.

* * * * *